US008418744B2

(12) United States Patent
Balasubramanian et al.

(10) Patent No.: US 8,418,744 B2
(45) Date of Patent: Apr. 16, 2013

(54) MOLTEN METAL CASTING DIE

(75) Inventors: Krishnamurty Balasubramanian, Hyderabad (IN); Radha Madhab Mohanty, Cuttack (IN)

(73) Assignee: Nonferrous Materials Technology Development Centre, Hyderabad (IN)

( * ) Notice: Subject to any disclaimer, the term of this patent is extended or adjusted under 35 U.S.C. 154(b) by 80 days.

(21) Appl. No.: 12/730,732

(22) Filed: Mar. 24, 2010

(65) Prior Publication Data

US 2010/0243192 A1 Sep. 30, 2010

Related U.S. Application Data

(60) Provisional application No. 61/162,894, filed on Mar. 24, 2009.

(51) Int. Cl.
*B22C 3/00* (2006.01)

(52) U.S. Cl.
USPC ..... 164/72; 164/138; 249/114.1; 427/135

(58) Field of Classification Search ..... None
See application file for complete search history.

(56) References Cited

U.S. PATENT DOCUMENTS

| | | | | |
|---|---|---|---|---|
| 2,621,122 | A * | 12/1952 | Gresham et al. | 420/454 |
| 2,747,260 | A * | 5/1956 | Carlton et al. | 501/96.3 |
| 2,982,619 | A * | 5/1961 | Long | 75/245 |
| 3,588,028 | A * | 6/1971 | Okamoto et al. | 249/116 |
| 4,606,948 | A * | 8/1986 | Hajmrle et al. | 427/451 |
| 2003/0106198 | A1 * | 6/2003 | Kowalczyk et al. | 29/402.18 |
| 2003/0230393 | A1 * | 12/2003 | Kimura et al. | 164/113 |

* cited by examiner

*Primary Examiner* — Keith Walker
*Assistant Examiner* — Jacky Yuen
(74) *Attorney, Agent, or Firm* — Joseph M. Noto; Bond Schoeneck & King, PLLC

(57) ABSTRACT

A molten metal casting die having a modified surface, a method for making such dies, and a method for making articles of manufacture from such dies is disclosed. The methods are designed to protect die steel surfaces having a protective coating from corrosion by molten metals substantially containing liquid copper.

6 Claims, 10 Drawing Sheets

MOLTEN METAL CASTING DIE

This application claims the benefit of U.S. Provisional Patent Application Ser. No. 61/162,894, filed Mar. 24, 2009, which is hereby incorporated by reference in its entirety.

FIELD OF THE INVENTION

This disclosure relates to a molten metal casting die having a modified surface, a method for making such dies, and a method for making articles of manufacture from such dies. The methods and dies protect die steel surfaces from corrosion by molten metals substantially containing liquid copper.

BACKGROUND OF THE INVENTION

Pressure die-casting is recognized as a well-established, economical method for manufacturing products and practical for the production of die-cast rotors. Pressure die-casting is widely used in aluminum die-casting. Tool steel mold and accessories used for the aluminum die-casting process have been observed to be inadequate when casting higher melting point metals such as copper. There remains however great interest in building rotors based on copper. Cu-based rotors are more efficient than comparably sized aluminum-based rotors. When the power is kept constant copper-based rotors are smaller than aluminum-based rotors, thereby reducing weight and saving energy. Some high-temperature, high performance materials have been available for many years, e.g., super alloys and refractory metals, such as tungsten and molybdenum. These materials can be used as die materials or a low cost option for use as die insert materials. The primary expense factor for manufacturing die-cast products is the cost of materials. For commercial application the materials noted above cannot be used. The lack of availability of a cheap and durable mold has emerged as an initial technical barrier for commercial manufacturing of copper based die-cast products.

Steel H-13 is a relatively cheap material which allows dry mold release, and fast cycle time. In the United States H-13 steel is denominated as follows: ASTM A681, FED QQ-T-570, SAE J437, SAE J438, SAE J467, UNS T20813. Some unique characteristics of H-13 steel include its ease to work with and availability, making it one of the most popular hot working die steels. Among some of its properties are its thermal shock and fatigue resistance, superior machinability and polishability. In addition, it has proven endurance for mechanical and thermal impact of molten aluminum. However, liquid aluminum is observed to be chemically reactive and easily forms alloys with alloy constituents of H-13 steel dies. This is particularly true when the H-13 steel composition contains copper as one of its constituents.

Researchers have concentrated on developing and evaluating thin coatings on H-13 steel typically applied by physical vapor deposition techniques (PVD), chemical vapor deposition (CVD), and nitriding techniques. Coatings typically deposited by these techniques include CrN, CrC, $B_4C$, VC, $CrN_2$, and ion nitriding. The materials have been chosen due to their resistance to soldering in the presence of liquid Al, which has a melting point of about 660° C. The primary failure mechanism of these coatings is spalling, that is the formation flakes delaminating from the coating, due to differences in the coefficient of thermal expansion (CTE) between the coating and the substrate. Nitridation of H-13 steel prolongs the die life in the presence of liquid aluminum.

Even if a coating material is solder resistant, the ability to coat it on a die surface and keep it on a die surface is a technical challenge.

Physical vapor deposition includes heating a source material by resistive heating, plasma sputtering, laser ablation or any other form of energy that will cause the source material to evaporate and "land" on the target material, thus forming a thin layer, coating or thin film. There are several variants for achieving the same goal. In one case source materials may be heated to high vapor pressure by resistive heating. In another variant the source material is heated to high vapor pressure by electron beams under high vacuum. Other heating modes include sputter deposition in which a glow plasma discharge bombards the source material leading to the formation of vapor. Pulsed laser beams may also be used to evaporate the target material. In all cases the vapors condense on the target substrate giving rise to thin coatings or films.

For copper, having a melting temperature of 1083° C., die casting requires pouring temperatures near 1200° C. Casting under these conditions and for copper in particular is characterized by a high heat of fusion, substantial latent heat, and high thermal conductivity. Typical H-13 steel type dies soften at 1200° C. H-13 steel has strength of 100 MPa at about 1200° C., whereas the strength at room temperature is about 1000 MPa. Technical literature shows that some of the major problems associated with H-13 type mold materials at about 1200° C. are: early onset heat checking (thermal strain on surface/appearance of fine cracks due to alternate heating and cooling cycles.), oxidation at high temperature, corrosion and soldering of liquid metal to the stainless H-13 surface, erosion wear by molten metal, and modifying the surface wetting/capillary action after solidification. Furthermore, H-13 steel may in some cases contain up to 0.25% Cu, thereby increasing the possibility of reaction in the liquid solid interface.

SUMMARY OF THE INVENTION

In accordance with an embodiment, a method for protecting the surface of a die useful for casting of copper articles includes, providing a steel die and applying a protective coating to a surface of the die which contacts molten copper, wherein the protective coating includes at least one layer of a material substantially impervious to molten copper.

In accordance with an embodiment, a system for casting copper articles includes, a substrate composed of a steel surface; at least one protective coating including Ni and refractory addenda deposited onto the steel surface; and molten copper in contact with the protective coating.

In accordance with an embodiment, a method for forming a cast copper object includes the steps of melting copper in a container; pouring the molten copper into a second container coated with at least one protective layer including at least one of Ni, Ni alloys, composites and ceramic; allowing for appropriate phase transitions of the molten copper; and releasing the cast form from the second container.

In accordance with an embodiment, a mold filled with a liquid metal includes liquid copper in contact with a protective coating on a steel surface of the mold, wherein the protective coating is substantially impervious to molten copper.

In order for steel surfaces, such as H-13 steel, to be effectively used they are preferably engineered by one or more treatments. In some cases mechanical and chemical surface treatments are desired in order to improve the surface and subsurface layers. In addition, during hot working conditions these treatments can alleviate the damages due to both mechanical and thermal stresses. Yet some other treatments can help in holding back the nucleation and propagation of heat micro-cracking. It is found in general that treatments will prolong the service life of hot working dies.

Modifying the surface and subsurface of the mold is a reasonable approach to extend its life thereby making it more economical to use. Surface modification will preferably alleviate the damage due to thermal and mechanical stresses, and hold back nucleation and heat checking. In addition, surface modification may include the deposition of protective layers that prolong the service life of the mold.

Thermodynamic calculations suggest that the candidate coatings should be non-wetting to molten copper, and have the ability to adhere well to iron-based substrates like steel. In addition, the coatings should not form intermediate compounds or alloys with molten copper. Finally, the coatings should bear high heat and erosive loads with adequate soldering and oxidation resistance.

It is one object of the present invention to treat steel surfaces to increase the resistance to checking. Another aspect of the present invention is to increase the surface hot strength of steel articles of manufacture. Yet another aspect of the present invention is to increase the surface hardness (wear resistance) while improving the ductility. Another aspect of the present invention is to increase the resistance to oxidation. In a preferred embodiment the die is made from H-13 steel.

The objectives of the present invention are achieved in part by surface modification of steel surfaces, in particular H-13 steel, by suitable choice of coating processes, coating materials and the proper testing and result analysis process. In this particular invention both ceramics as well as metallic coatings have been combined with a multilayer or single layer thermal plasma process. H-13 steel substrates in particular were selected from but not limited to cylinders, prototype containers of rectangular as well as circular shaped molds. It will be understood by those skilled in the art that other shapes may be useful as dies.

The effectiveness of a given coating or family of coatings were evaluated based on qualifying tests, including pre and post test of surface roughness, phase analysis, chemical, thermal and mechanical performance. Typical tests include "finger" dipping of samples consisting on bulk H-13 steel substrates, coated in accordance with this invention, in molten copper followed by the microscopic inspection of surface damage.

In one particular example of testing the following parameters are considered. Coating durability by long cycle dips of 40-60 seconds for duty cycles of 200-300 times cycles. This is followed by macroscopic and microscopic inspection and X-ray diffraction analysis to determine the formation of new crystalline phases in the bulk and/or in the surface layers. In addition, energy dispersive x-ray spectroscopy (EDS) is performed in conjunction with scanning electron microscopy where the migration of coating components into the bulk of H-13 steel or the migration of copper atoms into the coating and the H-13 steel substrate is explored. Scanning electron microscopy provides a look at the surface of the coating and at the interface of coating/substrate, thus providing an area view of porosity, delamination, oxidation, and external and internal damage. From these tests it is possible to estimate the residual life of the structure, microstructure, strengthening, and wetting with molten copper.

In one particular embodiment a multilayer is used including: a layer adjacent to H-13 steel selected to provide bonding to the surface. In one example, a metallic layer of NiCrAlY provides satisfactory bonding to the surface of H-13 steel and serves as a base or transition layer for a top coating. Top coatings are selected from ceramics thermodynamically stable toward liquid copper. In one particular embodiment, ceramics including individual compositions are based on $ZrO_2$, $Y_2O_3$, $Al_2O_3$, TiO2, $B_4C$, and Fe—B. In another particular embodiment $ZrO_2$, $Y_2O_3$, $Al_2O_3$, TiO2, $B_4C$, and Fe—B were dispersed in a composite condition prior to coating layers. In yet another example and in an effort to reduce cost and manufacturing steps metallic top coatings including NiCrAlY, NiCr, and Co—Ni—Cr—W were applied to H-13 steel surfaces resulting in a satisfactory outcome.

Some of the advantages of the articles and processes disclosed herein may be summarized as follows: The examples provide for a more permanent protection of the die as compared to release layer-like or lubricant methods. Another advantage is the enhancement of thermo mechanical endurance of H-13 steel for copper die casting. This in turn provides for a cost effective method for die casting of a copper rotor motor. In addition, physical vapor deposition processes have advanced enough so that good reproducibility is routinely attainable, thus making it possible to increase the surface strength and hardness of H-13 steel by multilayer or single layer coatings in accordance with the present invention. In addition, the process described by this invention not only satisfies metallurgical requirements, based on alloy phase diagrams, but also forms and maintains smooth surfaces even after casting numerous times. Another feature of the protective layer(s) is that they prevent decarburization (removal of carbon alloyed to H-13 steel for strengthening), oxide formation, silica formation, and iron depletion from H-13 steel. The process also prevents the increase in Cr and Si concentration in surface regions. Furthermore, the coatings may be applied to other types of articles selected to handle molten metals, copper in particular. In one example nozzles, forming tools, runners, and a variety of containers may be coated. Mold design becomes significantly easier since the coatings herein disclosed do not significantly alter the dimensions of the mold.

The following results have been achieved: A combination of metal and ceramic, metal-metal up to about 400 microns thick protects H-13 steel during copper die casting. Using Ni-based materials with refractory additions and coating up to about 300 microns protects H-13 steel during copper die casting. Using a Ni-based dispersoid material with refractory addition up to about 300 microns thick protects H-13 steel during copper die casting. The present invention includes an apparatus for evaluation of the life of an H-13 steel die. The present invention also includes a process where a thermal data recorder is used to predict the surface condition of the samples under testing.

DETAILED DESCRIPTION

Figure 1:
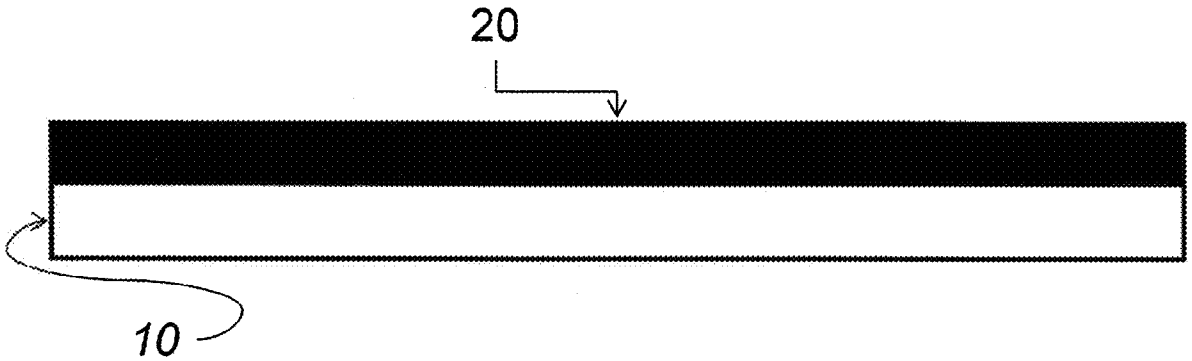
FIG. 1 is a drawing of a substrate according to the present invention having a single layer coating.

Die casting can be generally described as forcing molten metal under pressure. There are typically four steps associated with die casting methods: the mold is sprayed or otherwise coated with a lubricant to help the molten metal fill the cavity of the mold and to help release the formed part after casting. This step is followed by injecting molten metal under high pressure (usually between 1500 to 25000 psi). Once the die is filled the pressure is kept constant until the metal solidifies. Then the die is opened and the part or parts are ejected by the help of ejector pins or other similar devices which push on the part from the external wall of the die. What follows is the separation of unwanted extensions or protrusions from the part formed during casting. Machining, and polishing steps will give rise to the finished part. Typical components of a die are a mold, which is a hollowed-out block of metal to be filled in by a liquid, in this case molten metal. The mold may contain inserts which will keep certain volumes, associated with their shapes, from filling with the liquid. In addition, the mold may contain ridges and hollowed areas that fill with the liquid also in relation to their shapes and corresponding volumes. After solidification when the inserts are removed the formed part will reflect the shapes of the inserts. In accordance with the present invention, the die is coated with at least one protective layer. The at least one layer can be a single layer or a multi-layer configuration. The multi-layer configuration includes a two-layer configuration wherein a transitional layer has a top coat layer. The multi-layer configuration preferably includes a three-layer configuration. An article of manufacture includes a substrate having a steel surface; at least one protective coating, such as Ni, and refractory addenda deposited onto the surface; and molten copper in contact with the protective coating. The steel surface can be H-13 steel. The protective coating is preferably at least about 100 microns thick. Preferably, the protective coating is from about 100 to about 400 microns thick. The coating preferably includes at least one of the following compositions Ni—Cr—(Mo—Ta— Nb), Ni—Cr— (Ti—Mo—Ta— Nb), Ni—Cr—(Zr—Mo—Ta— Nb), Ni—Cr— other active elements, and dispersoids like NiCr—$Cr_2C_3$.

A method for protecting the surface of a die used in the casting of copper articles, includes providing a substrate die made from steel, such as H-13 steel, and applying a protective coating to a surface of the die which contacts molten copper, wherein the coating includes at least one layer of a material substantially impervious to molten copper. It should be noted that in some cases a top coating of a metal oxide may be reacted with liquid copper or solid copper in situ at a high temperature, thus forming a passivation layer of a metal oxide cuprate. In one particular embodiment this passivating layer is copper aluminate, $CuAl_3O_4$. It is noted that copper aluminate is only an example and that other thermodynamically driven compositions may be formed depending on the chosen top coating. These types of solid/solid or solid/liquid reaction are thermodynamically driven, as noted, but kinetically limited by diffusion requirements into the solid. The protective coating is at least a single layer, preferably having a thickness in the range of about 100 microns or more, wherein the layer contains nickel and chromium with the addition to at least one of the following materials, molybdenum, tantalum, niobium, titanium, yttrium, aluminum, and zirconium. The protective layer preferably includes at least two layers of materials, wherein one of the layers is a transitional layer in contact with the steel die and the other is a top layer which contacts the molten copper. The transitional layer preferably includes nickel, chromium, aluminum or yttrium; and the protective layer preferably includes $Al_2O_3$, $Al_2O_3.TiO_2$ or yttrium stabilized zirconia (YSZ). The top coat preferably includes the ceramics $ZrO_2$, $Y_2O_3$, $Al_20_3$, $TiO_2$, $B_4C$ or Fe—B. The ceramics can be in a dispersed composite condition or in individual layers. The top coat can include NiCrAlY, NiCr or Co—Ni—Cr—W. The protective coating can include three layers of material, including a transitional layer, a spatially graded coating with varying transversal composition, and a top coating which is in contact with the molten metal. Preferably, the three layer embodiment includes a transitional layer of NiCr—$Cr_3C_2$ followed by a second layer of molybdenum silicide in combination with aluminum oxide ($MoSi_2$+$Al_2O_3$) and a third layer of aluminum oxide ($Al_2O_3$). In a further embodiment, the transitional layer includes $Al_2O_3$ followed by a second layer of molybdenum silicide in combination with aluminum oxide ($MoSi_2$+$Al_2O_3$) and a third layer of NiCr—$Cr_3C_2$. The spatially graded coating can include zirconium oxide with yttrium oxide additions in varying proportions as a function of distance from the substrate surface. Metallic coatings include NiCrAlY, NiCr, NiCrAlY—NiCr, Stelite (Co 68% etc), Ni base super alloy, and Ni— 22Cr-9Mo-4Ta-4Nb. Ceramic coatings include $Y_2O_3/ZrO_2$ and $Al_2O_3/TiO_2$.

A method of protecting the surface of a die used in the casting of copper includes providing a die made from steel, such as H-13 steel, and applying a protective coating to the die which includes at least one layer of material substantially impervious to molten copper. By substantially impervious it is meant that the layers will not react chemically with molten copper to form a mixed oxide compound, such as a cuprate. In this particular context materials can be made impervious in at least two ways. One is by the deposition of protective coatings or thin films, and the other is by passivation. Passivation is a process by which materials are protected in relation to one another by previously reacting the materials and forming "passivating layers" or in many cases intermediate compounds that prevent further reaction. These steps are normally confined to the surfaces of the materials in question and characteristically no further bulk reactions occur at a given set of conditions. A typical method for coating the inner surface of a cylindrical die includes the application of a conventional PVD process.

Pretreatment. This step relates to removing any grease or contaminant that may be adhering to the surface. This is done to ensure adhesion of the coating and to avoid the formation of carbonaceous residues that may form as a result of the calcinations of any organic substances, including greases adhered to the surface of the substrate or target at high temperatures. Typical degreasing steps include washing with detergents like Alconox, rinsing in de-ionized water, optionally this is followed by a rinse in dilute nitric acid followed by a rinse in de-ionized water to removed acid residues. This step is usually followed by drying at 110° C. in a dust free environment. After drying the substrate is mounted on the coating chamber where vacuum is pulled. In some cases the substrate is heated in order to de-gas it. After this step the substrate is considered ready for coating or thin film deposition.

Deposition. This step relates to evaporating the source material into the substrate (target). The evaporation step may be done in various forms as noted above: electric resistive heating, electron beams, sputtering, cathodic arc heating, or laser ablation. In all cases it is desired to achieve a coating of uniform thickness. Uniform coatings may be achieved by rotating the target substrate and by heating in order to cause surface diffusion of the impinging particles. This may also be achieved by moving the heated source across the substrate surface. In accordance with the present invention, this system may include use of at least one source of material. In the multilayer embodiment, each layer may be deposited in a single step followed by annealing, changing the source material and repeating the cycle. In other embodiments, at least two "boats" containing the source material or solid slabs made out of the source material are loaded into the deposition chamber and evaporated in the order required. In other embodiments, multiple boats or solid slabs of material are loaded into the deposition chamber so that vacuum is not broken and the likelihood of oxidation is diminished. Systems that permit the transfer of new materials into the deposition chamber without breaking the vacuum can be employed.

Annealing. This step ensures that the adsorbates making up the coating(s) have an opportunity to bond to the substrate and to form a continuous film or coating. In addition, annealing permits the removal of defects and stresses.

A method of forming a cast copper object includes the steps of melting copper in a container; pouring molten copper into a second container coated with at least one protective layer of at least one of Ni, Ni alloys, composites and ceramic; allowing for appropriate phase transitions; and releasing the form from the second container. The mold is filled with a liquid metal including liquid copper in contact with a protective coating on a steel surface, wherein the coating prevents the chemical reaction of the molten copper with the steel surface. The temperature of the mold can be monitored by modulating with an internal heater or an external heater.

Figure 2:
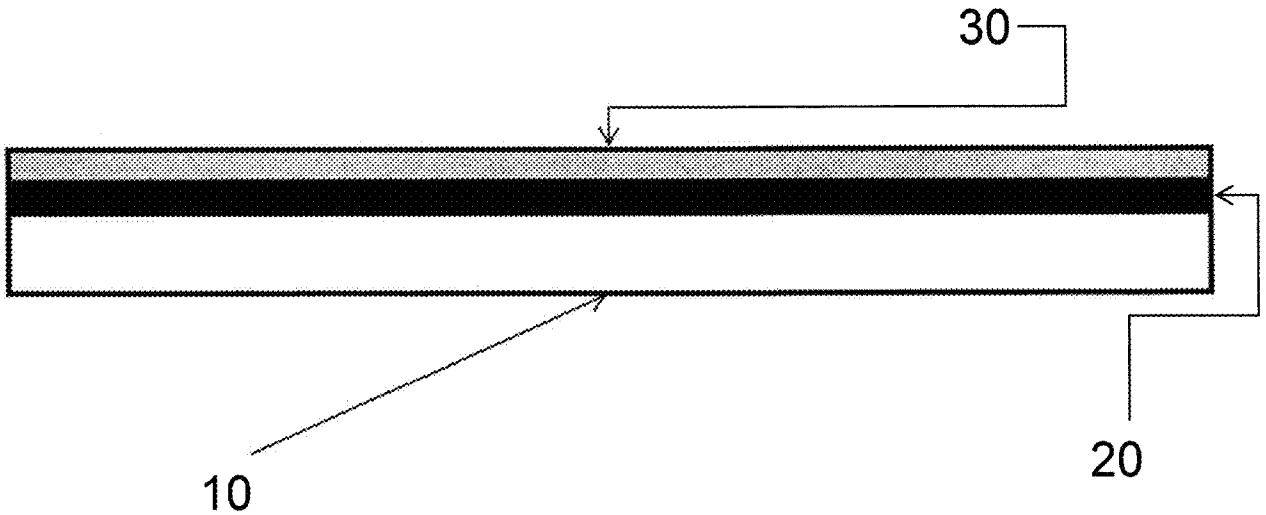
FIG. 2 is a drawing of a multilayer-coated die according to the present invention for casting molten metal.
Figure 4:
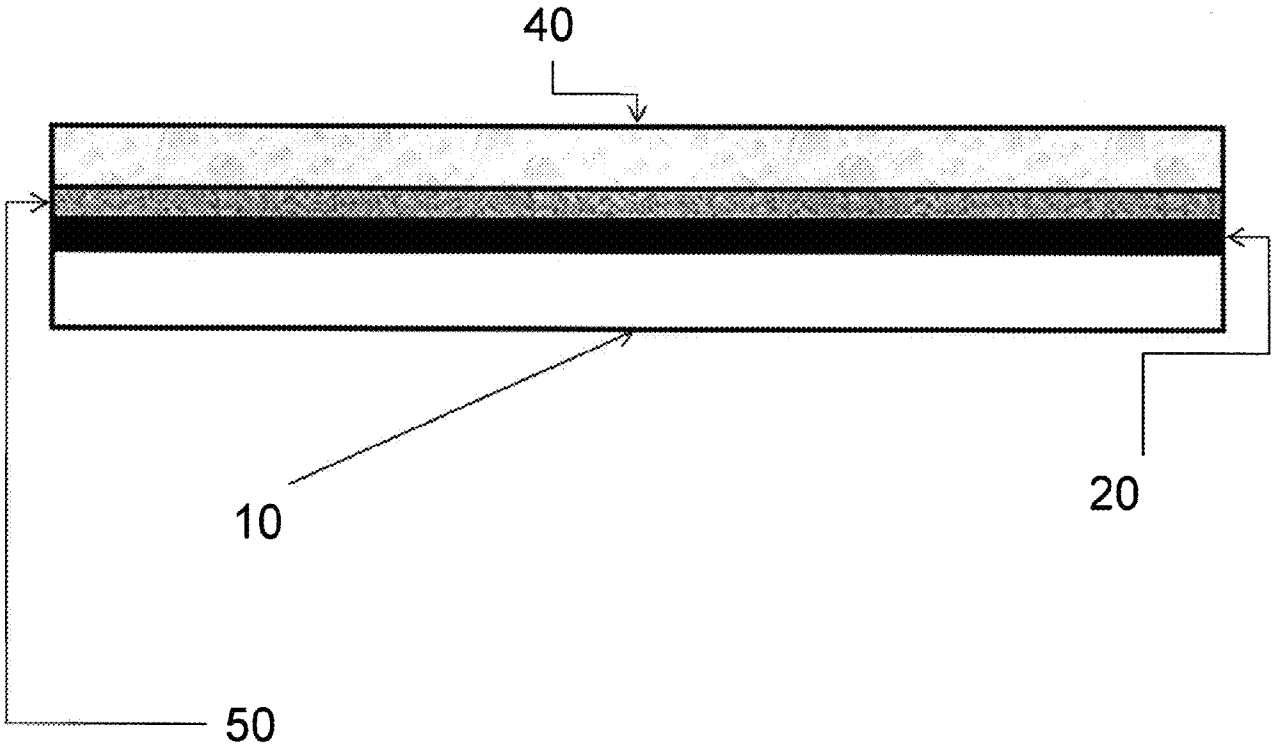
FIG. 4 is a drawing of a substrate according to the present invention having a composite coating in contact with molten metal.

In one preferred embodiment, the structure shown in FIG. 2, a coating of Nickel-based alloys is deposited as a transition layer 20 to facilitate bonding of the top coat layer 30 into the substrate 10. The top coating adjacent to the nickel alloy may include a single ceramic or a combination of materials selected from the following group: $ZrO_2$, $Y_2O_3$, $Al_2O_3$, $TiO_2$, $B_4C$, and Fe—B. In some cases these ceramic coatings were used individually and in some other cases they were in a dispersed composite condition (FIG. 4). Let it be understood that as described herein a dispersed composition may take an unusual form. A dispersed composite in general is a multiphase (more than one inorganic material). In accordance with the present invention there is a minimum of two phase mixtures or a solid solution of two ceramic materials. An example of the former includes a mixture of known proportions of aluminum oxide and titanium dioxide; in one particular structure this is preferably 70%:30% by weight.

FIG. 1 shows an H-13 steel substrate 10 having a steel surface selected to facilitate the fabrication of dies to which is bonded a protective layer 20, such as a layer of metal alloys, ceramics, or composites.

FIG. 2 shows a multilayer-coated die for casting molten metal including an H-13 steel substrate 10 selected to facilitate the fabrication of dies to which is bonded a transitional layer 20 of nickel. Onto this nickel layer 20 is bonded a second layer 30 including intermetallic metal alloys, ceramics, and composite ceramics as a top coat for contact with molten metal.

Figure 3:
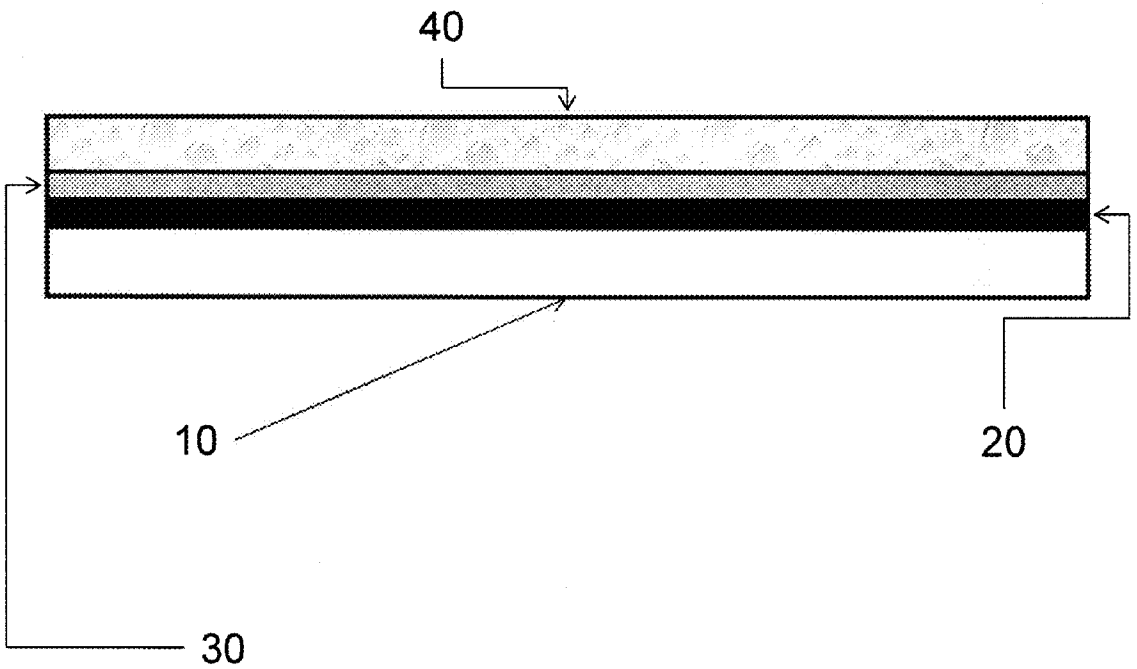
FIG. 3 is a drawing of a multilayer-coated die according to the present invention in contact with molten metal.

FIG. 3 shows a multilayer-coated die in contact with molten metal including an H-13 steel substrate 10 selected to facilitate the fabrication of dies to which is bonded a transitional layer 20. Onto this transitional layer 20 is bonded a second layer 30 that is a refractory. Layer 30 is in contact with molten metal 40.

FIG. 4 shows a composite coating in contact with molten metal including an H-13 steel substrate 10 selected to facilitate the fabrication of dies to which is bonded a transitional layer 20. Onto this transitional layer 20 is bonded a second layer 50 of a ceramic composite. Layer 50 is in contact with molten metal 40.

Figure 5:
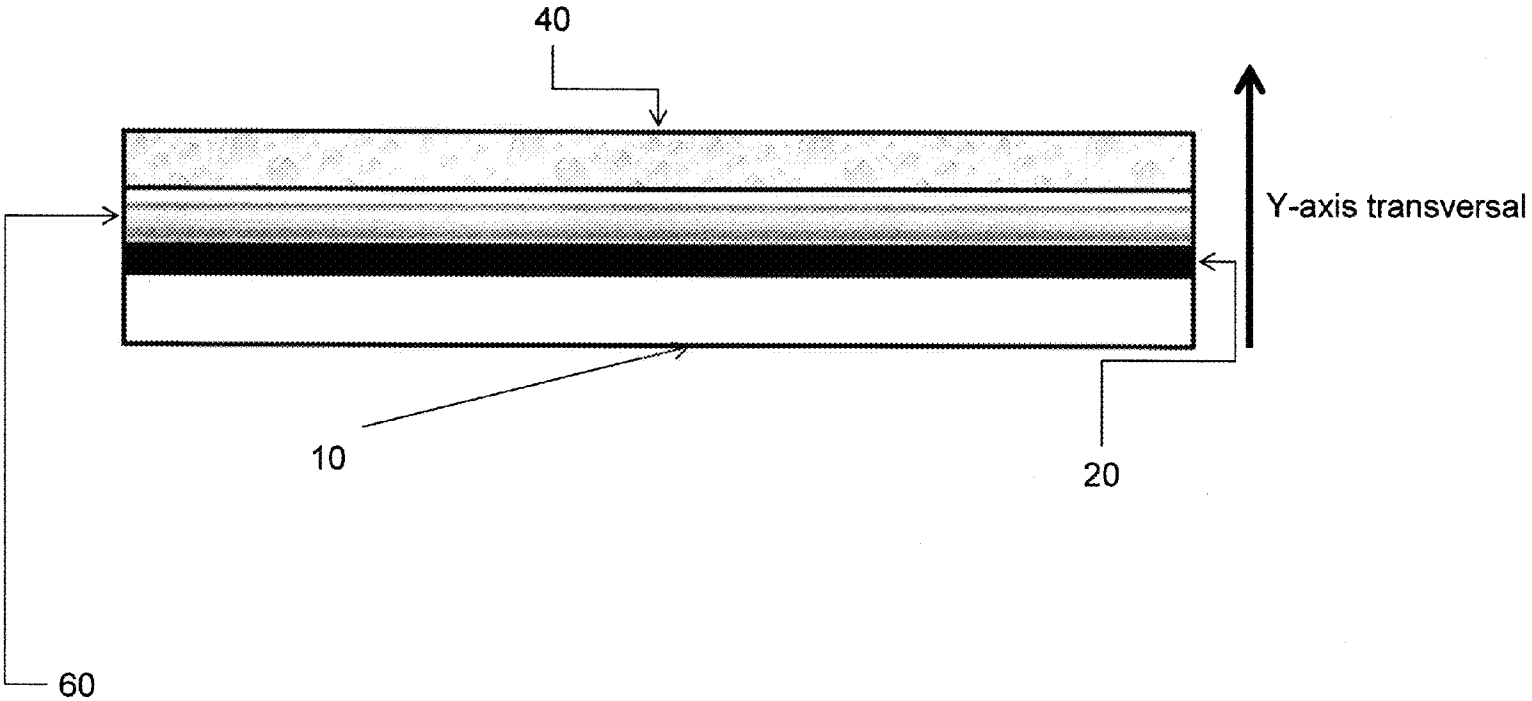
FIG. 5 is a drawing of a substrate according to the present invention having a transversally graded coating in contact with molten metal.

FIG. 5 shows a transversally graded coating in contact with molten metal including an H-13 steel substrate 10 selected to facilitate the fabrication of dies to which is bonded a transitional layer 20. Onto this transitional layer 20 is bonded a transversally graded composite coating 60 where the composition of the composite varies along the Y-axis of the coating. The graded coating 60 is spatially graded with varying transversal composition $nA(1-n)B$, where the value of the coefficient n varies from 0 to 0.2, such that $0 \leqq n \leqq 0.2$.

Figure 6:
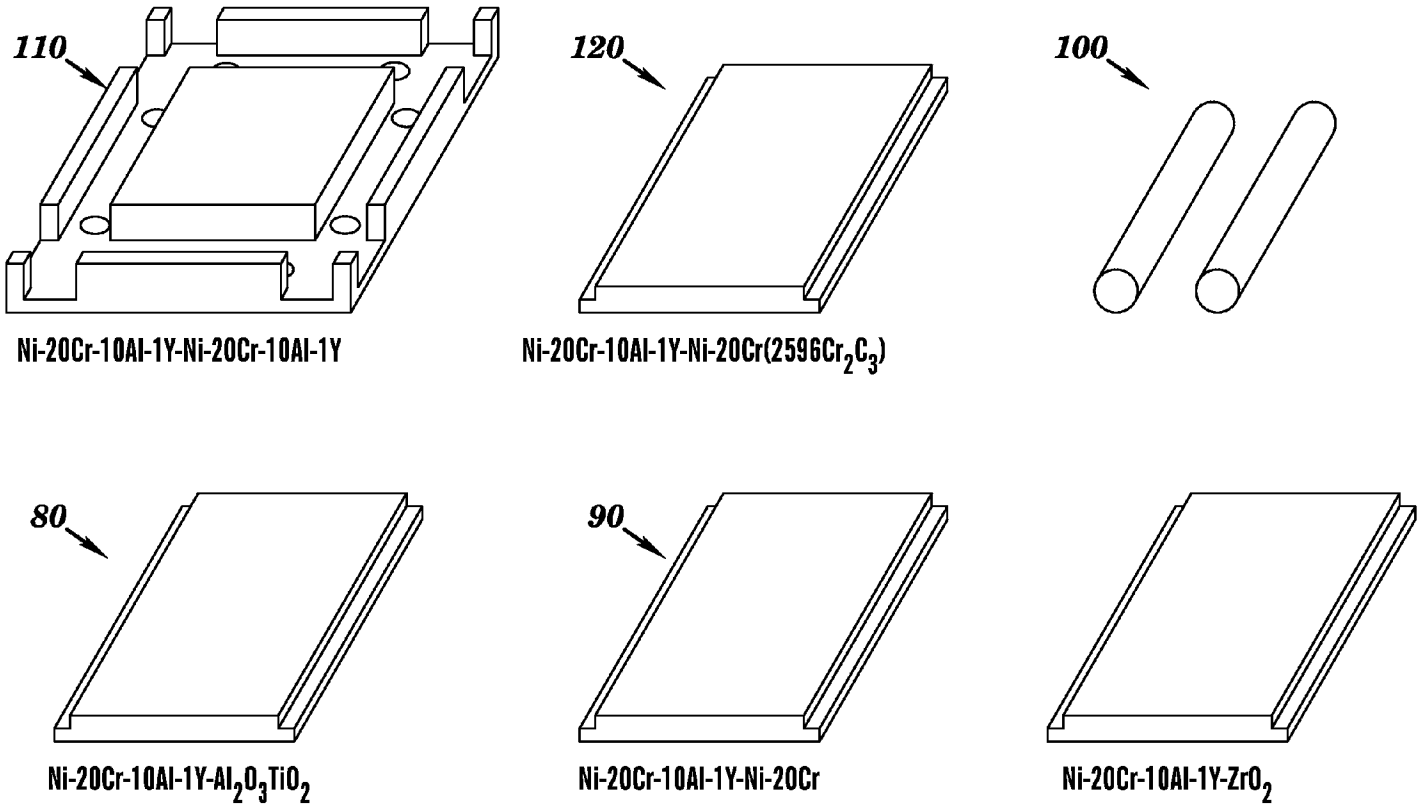
FIG. 6 is a picture of various geometrically shaped H-13 test pieces having multilayer coatings according to the present invention.

FIG. 6 shows various dies illustrating how complex geometries can be coated with layers of relative uniform thickness, including multi-layers on H-13 steel test pieces. Specifically, FIG. 6 shows a coated edge 80, a coated corner 90, a coated cylindrical shape 100, a coated channel 110, and a coated ledge 120 of various test pieces.

Figure 7:
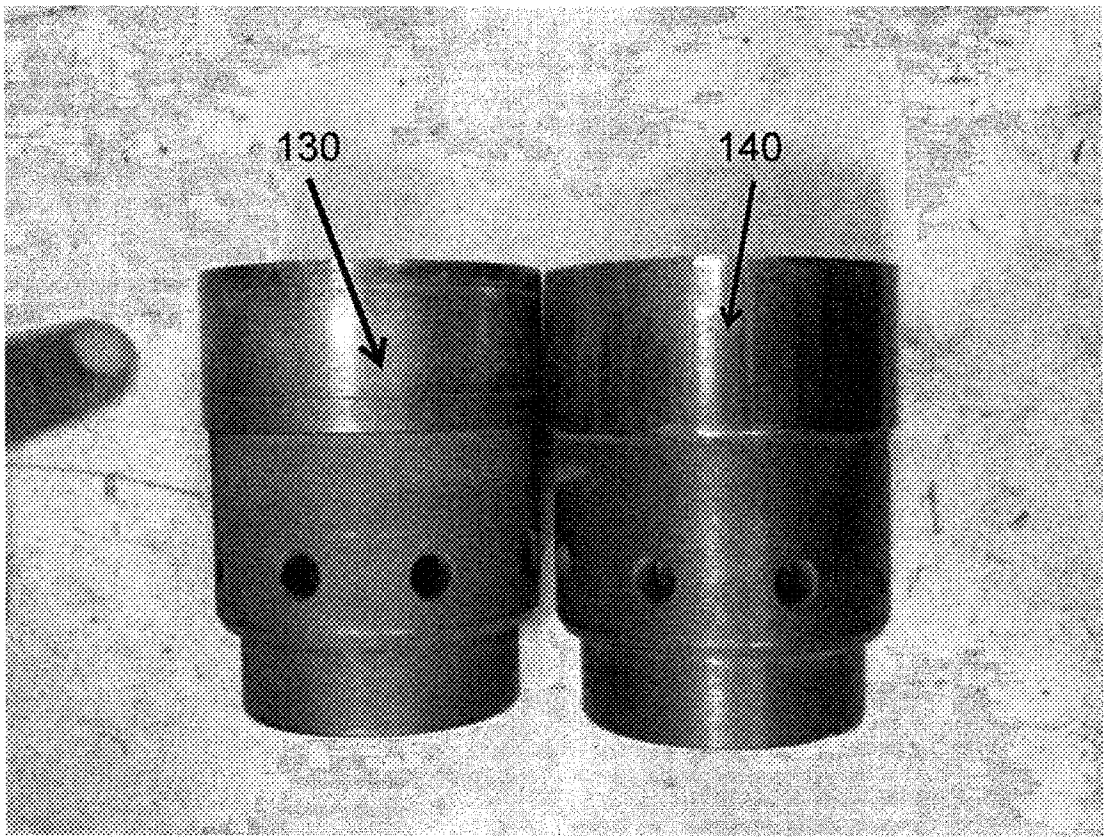
FIG. 7 is a picture of a set of parts, one uncoated comparative part and the other part coated with a single layer prepared in accordance with the present invention.

FIG. 7 shows two H-13 steel parts, one part 130 coated with a single layer of Ni and the other comparison part 140 uncoated. The appearance difference between Ni-coated H-13 steel 130 and a short cycle uncoated H-13 steel 140 can be seen. A comparison of the parts by visual inspection illustrates how the coating protects H-13 steel.

Figure 8:
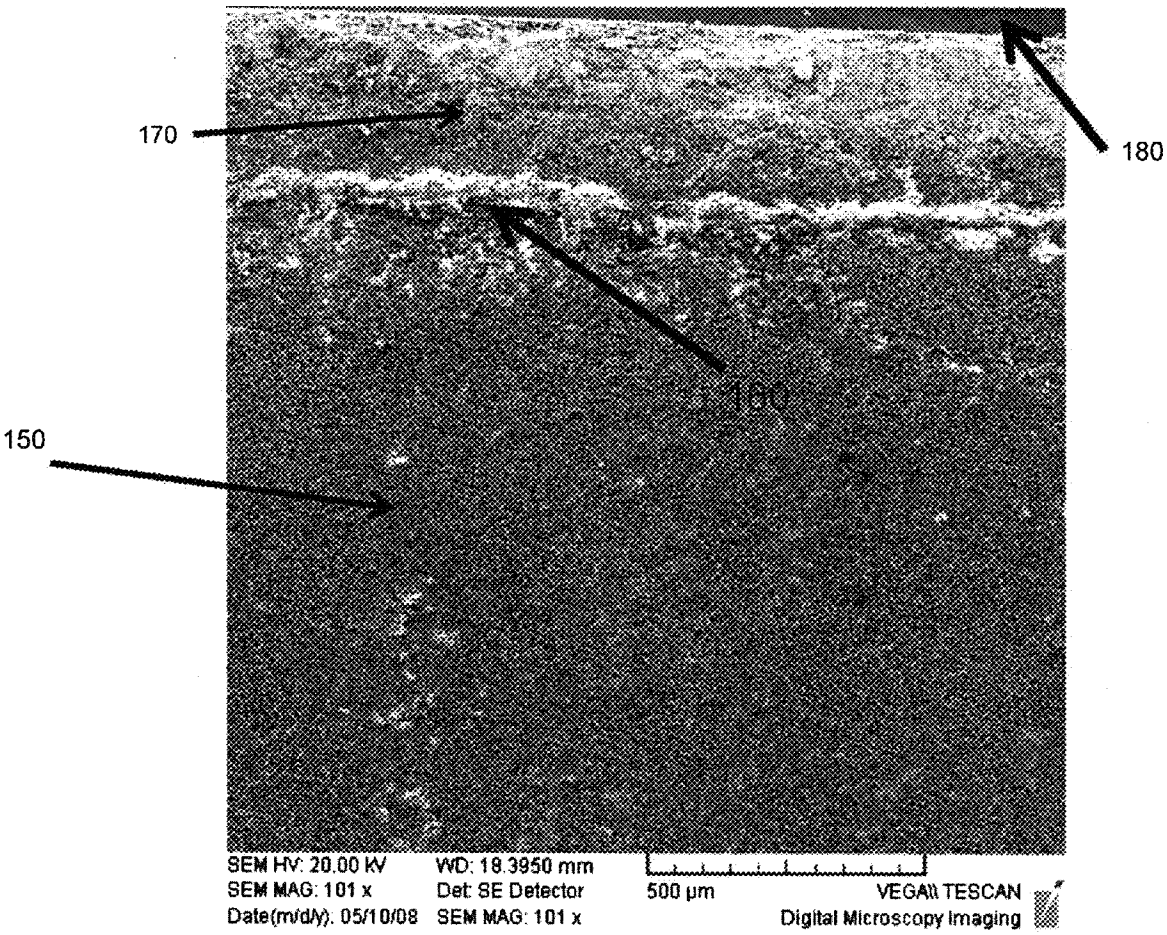
FIG. 8 is an Scanning Electron Microscope image of a single layer coated H-13 component after 300 heat cycle up to 1200° C.

FIG. 8 shows a single layer 170 coated H-13 steel substrate 150 component, the corresponding interface 160, and the molten metal top coat interface 180 illustrating no damage to the H-13 steel substrate after 300 heat cycles up to 1200° C., in accordance with the present invention.

Figure 9:
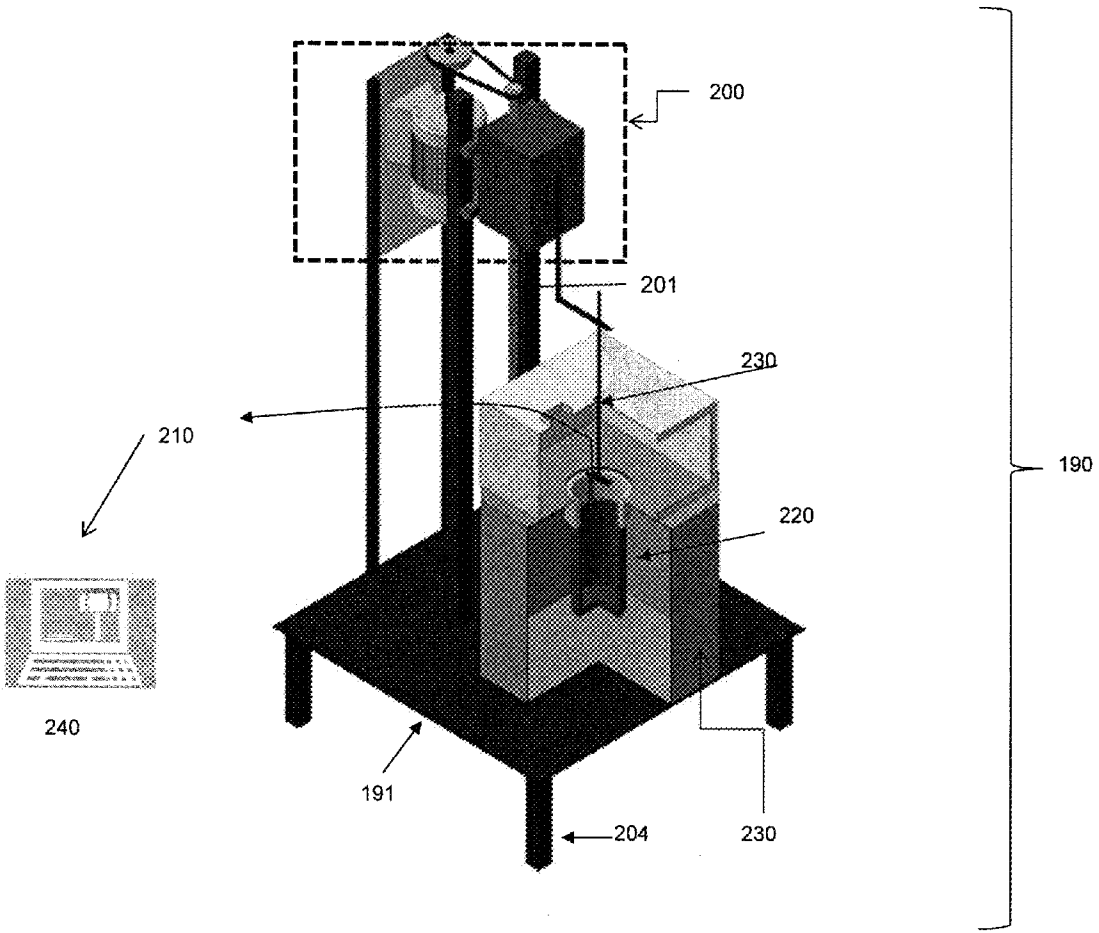
FIG. 9 is a perspective view of an H-13 die steel immersion test apparatus.

FIG. 9 shows an immersion test rig apparatus for copper die casting with cyclic erosion tests for automated dip testing. An H-13 steel die immersion test apparatus 190 is shown having a motor driven system 200 for dipping test sample supported by four columns 204 and a base 191. Test sample 230 is dipped by rotating a corkscrew spindle shaft 201 into a crucible 220 containing liquid copper kept molten by heating furnace 230. Thermal changes are controlled and monitored by a thermal data acquisition system 210 which is controlled by a computer 240. The apparatus can achieve heating up to about 1250° C. and can run continuously for many days. The system is integrated with mechanical and temperature sensors with computer compatibility for automated data acquisition.

Figure 10:
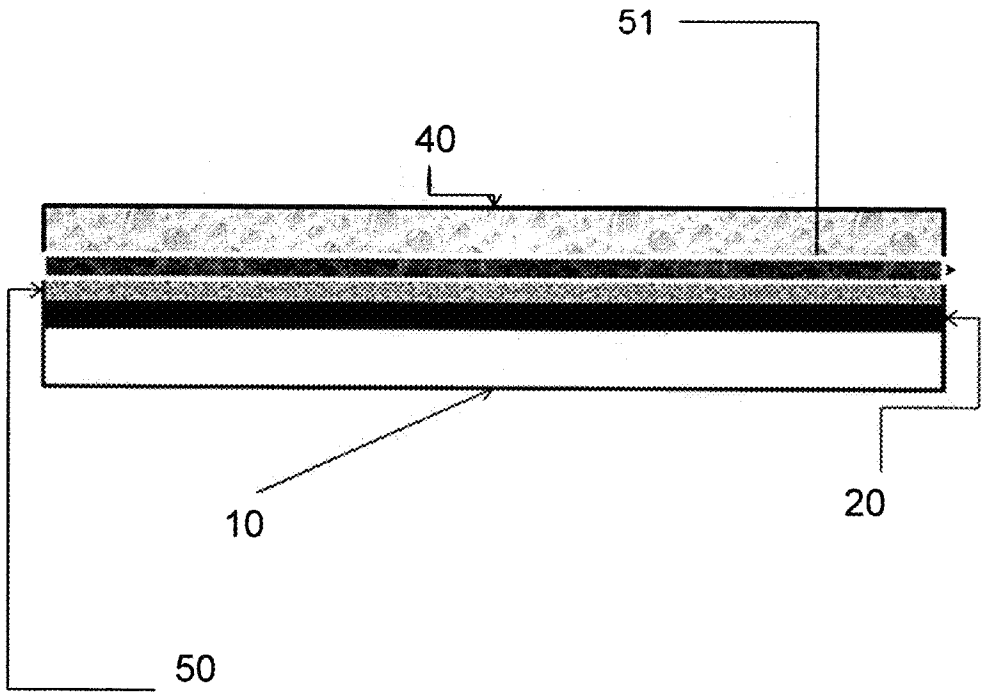
FIG. 10 is a drawing of a substrate according to the present invention having a passivation layer in contact with molten metal.

FIG. 10 shows a composite coating in contact with molten metal including an H-13 steel substrate 10 selected to facilitate the fabrication of dies to which is bonded a transitional layer 20. Onto this transitional layer 20 is bonded a second layer 50 of a ceramic composite. Layer 50 is pre-reacted with molten or solidifying copper metal 40 to form a passivating layer 51 of bimetallic oxide, such as copper aluminate.

EXAMPLES

TABLE I

| Ni Alloy Transition Layers with Oxide Top Coat | | |
|---|---|---|
| Example Number | Transition Layer | Top Coat |
| 1(a) | NiCrAlY | $ZrO_2$ |
| 1(b) | NiCrAlY | $ZrO_2$ and $Y_2O_3$ in 50/50 Ratio |
| 1(c) | NiCrAlY | Mixed oxide phase 1/3(50% $ZrO_2$ 50% $Y_2O_3$) containing both 1/3$Al_2O_3$ and 1/3$TiO_2$ |

Example 1(a)

NiCrAlY was used as the transition layer 20. The top coat 30 was formed with $ZrO_2$.

Example 1(b)

NiCrAlY was used as the transition layer 20. The top coat 30 was formed by a mixture of $ZrO_2$ and $Y_2O_3$ in a 50:50 ratio.

Example 1(c)

The dispersed composite is a mixture of aluminum oxide, titanium oxide and a mixed oxide phase ⅓(50% $ZrO_2$: 50% $Y_2O_3$) containing both ⅓$Al_2O_3$ and ⅓$TiO_2$, thus giving rise to three phase composite mixtures.

In another embodiment, for example, a plasma sprayed structure, the mixed oxide can form in situ (on the substrate). This is when the two individual oxides are in a mechanically or physically mixed condition in a powder feeder. They are sent through a high energy, high velocity plasma, generated in a plasma spray nozzle. Under these deposition conditions one may obtain combinations of one ceramic with another ceramic. In other cases, pre reacted $ZrO_2$ and $Y_2O_3$ containing 20 wt % $Y_2O_3$ is prepared as a single solid solution phase. It may then be spray coated onto the substrate. This second process known as stabilization of zirconium in general and yttrium stabilized zirconium in particular, is another example of the two ceramic oxides being spray coated in a plasma system after pre reaction for stabilization. It is noted that these mixtures may contain up to 20% $Y_2O_3$.

Example 2(a)

In a particular example of this structure aluminum oxide and titanium dioxide are physically mixed according to the following ratios or proportions for the formation of corresponding coatings a, b, c, and d:

a. 40 $Al_2O_3$: 60 $TiO_2$
b. 13 $Al_2O_3$: 60 $TiO_2$
c. 8 $Al_2O_3$: 92 $TiO_2$
d. 3 $Al_2O_3$: 97 $TiO_2$

Example 2(b)

Pre-reacted Yttrium stabilized Zirconia (YST) with formula 20% $Y_2O_3.ZrO_2$ is plasma coated.

Example 3(a)

A dispersed composite coating of multiple layers with $ZrO_2$ stabilized with yttrium ($Y_2O_3$) additions which are sprayed in such a manner wherein the $Y_2O_3$ content is changed after few layers giving a graded composite coating (FIG. 5). Here the composite is not only due to variation of the composition or the ratio of $ZrO_2$ and $Y_2O_3$, but also in spatial extent, as function of distance from the substrate surface.

Example 3(b)

A single layer metallic top coating such as NiCrAlY, NiCr, Co—Ni—Cr—W was used. This was done to reduce the cost further due to using a single layer and was based on the results obtained from the study of previous multilayer coatings.

TABLE II

| H-13 Steel-Nickel alloy (Compositions are in weight percentage) | |
|---|---|
| Example | Composition of Layer |
| Example 4(a) | (Ni—20Cr—10Al—1Y)—(Ni—20Cr) |
| Example 4(b) | (Ni—20Cr—10Al—1Y)—(Ni—20Cr—10Al—1Y) |
| Example 4(c) | (Ni—20Cr—10Al—1Y)—(Ni 20Cr)25$Cr_3C_2$ |

Example 4

In another embodiment, a multilayer coating structure having Ni-based alloys bond to H-13 steel to form a transition layer, i.e., zirconia. This can be represented by the following structure: (H-13 steel)-(Ni-based alloy)-($ZrO_2$). In one particular example, the Ni-based alloy is NiCr bonded to the H-13 steel substrate followed by a coating of zirconia ceramic which will make direct contact with the molten copper (H-13 steel)-(NiCr)—($ZrO_2$). These types of multilayer structures worked optimally for increasing the die life of H-13 steel during copper die casting.

Example 5

In another embodiment, multilayer coatings of Ni-based bond coats with H-13 steel —Ni (Compositions are in weight percentage is shown in Table III)

TABLE III

| H-13 steel - Ni-ceramic (Compositions are in weight percentage) | |
|---|---|
| Example | Composition of Layer |
| Example 5(a) | (Ni—20Cr—10Al—1Y)—($Al_2O_3$•$TiO_2$) |
| Example 5(b) | (Ni—20Cr—10Al—1Y)- 8 mol % YSZ ($Y_2O_3$—$ZrO_2$) |
| Example 5(c) | (Ni—20Cr—10Al—1Y)—($Al_2O_3$) |

In another embodiment, Example 6 shows multilayer coatings having Ni-based alloy bond coats with ceramic and alloy for in increasing the die life of H-13 steel during copper die casting as shown in Table IV.

TABLE IV

| H-13 steel - Ni-ceramic + alloy (Compositions are in weight percentage) | |
|---|---|
| Example | Composition of Layer |
| Example 6(a) | (Ni—20Cr—10Al—1Y)—($Y_2O_3$—$ZrO_2$)—(Ni—20Cr)25$Cr_3C_2$ |
| Example 6(b) | (Ni—20Cr—10Al—1Y)—($ZrO_2$—$Al_2O_3$) |
| Example 6(c) | H-13-(Co-balance-Ni10—Cr26—Fe1.5—Si1—Mn1—C0.5—W7.5) |
| Example 6(d) | H-13-(Ni—22Cr—9Mo—4Ta-4-Nb) |

Example 7

In this example, a few hundred micron thick Ni-based coatings are combined with the addition of refractory materials for purposes of applying individual coatings.

a. Ni—Cr— (Mo—Ta— Nb)
b. Ni—Cr— (Ti—Mo—Ta— Nb),
c. Ni—Cr— (Zr—Mo—Ta— Nb),
d. Ni—Cr— (NiCr—$Cr_2C_3$).

Example 8

Multilayer Structures

In Example 8 a multilayer with Ni based alloy intermediate bond coats with NiCr and with zirconia ceramic layers demonstrated an increase in the die life of H-13 steel during copper die casting (FIG. 5). Multilayer solution can be made from alloys such as Ni-20Cr-10Al-1Y, Ni-20Cr, (Ni 20Cr) 25$Cr_3C_2$ with or without a nickel based heat resistant alloy. Alternatively, a metallic base coat with top ceramic or metallic bond coat with ceramic followed by a heat resistant nickel based alloy, oxide/carbide dispersed alloy or an intermetallic, can form a 3 layer structure. These examples are shown in Table V.

TABLE V

| Three Layer Structures | |
|---|---|
| Example | Composition Examples |
| Example 8(a) | Ni—20Cr10—Al—1Y—($Al_2O_3$•$TiO_2$) |
| Example 8(b) | Ni—20Cr—10Al—1Y)-8 mol % YSZ $Y_2O_3$—$ZrO_2$ |
| Example 8(c) | Ni—20Cr—10Al—1Y—$Al_2O_3$ |
| Example 8(d) | Ni—20Cr—10Al—1Y—($ZrO_2$—$Al_2O_3$) |
| | Ni—20Cr—10Al—1Y—($Y_2O_3$—$ZrO_2$)—(Ni—20Cr)25$Cr_3C_2$) |
| Example 8(e) | Ni—20Cr—10Al—1Y—(NiAl). |

TABLE VI

| Preferred elemental and compound combinations Range of Elements Present in Alloys |
|---|
| C 0.09 to 0.23% |
| Cr 18 to 25% |
| Co 15.0% to 25.0 |
| Ti 1.0% to 5.0% |
| (Al + Ti) content 4.0 to 7.0% |
| (W + 1/2Mo) content must be at least 0.5-10% |
| Ta 1.0 to 4.2% |
| Nb 0.5 to 1.5%, |
| Zr 0.01 to 0.10% |
| B 0.001 to 0.01%. |

Example 9

Single Layer Plasma Coated Structure

The chemical elements and combinations in table VI can be used along with other candidates such as Ni—Cr— elements, and dispersoids such as NiCr—$Cr_2C_3$ as a single layer solution. The alloys can be solid solution strengthened or annealed. Some of the particular tested alloys (Example 9) are shown in Table VII. Die surfaces and areas in contact with liquid copper can be resurfaced with the following materials by using air plasma coating systems. In this particular example a few hundred micron Ni-based coating is combined with the addition of refractory materials so that the following alloys like Ni—Cr— (Mo—Ta— Nb), Ni—Cr— (Ti—Mo—Ta— Nb), Ni—Cr— (Zr—Mo—Ta— Nb) can result. The presence of elements making up the alloys are in the ranges as shown in table VI; C 0.09 to 0.23%, Cr 18 to 25%, Co 15.0% to 25.0, Ti 1.0% to 5.0%, (Al+Ti) content 4.0 to 7.0%, (W+½Mo) content is preferably at least 0.5-10%, Ta 1.0 to 4.2%, Nb 0.5 to 1.5%, Zr 0.01 to 0.10% and B 0.001 to 0.01%. These elements can be used along with other candidates such as Ni—Cr—, also active elements in promoting protection to the H-13 steel surface. In addition, dispersoids like NiCr—$Cr_2C_3$ applied as a single layer solution may be used. The alloys can be solid solution strengthened. Solid solution strengthening is a technique by which alloying elements are added to a base metal, in this case Ni, and diffused into the lattice to add strength. If the alloying element is past a certain range new phases will be formed therefore it is of utmost importance to establish working ranges. Another way of hardening the coating is by the technique known as age hardening also known as dispersion or precipitation hardening. This technique relies on the changes in solid solubility with temperature and the formation of impurity phases that impede the diffusion of defects or dislocations in the crystal lattice. Particular alloys tested are shown in Examples **9*a*-9*f*** in Table VII.

TABLE VII

| Tested Alloys Bonded to H-13 Steel | |
|---|---|
| Example 9(a) | H-13-(Co-bal-Ni10—Cr26—Fe1.5—Si1—Mn1—C0.5—W7.5) |
| Example 9(b) | H-13-(Ni—21Cr—20Co—3Mo—2.5W—(Nb + Ta)) |
| Example 9(c) | H-13-(Ni—22Cr—9Mo—4Ta—4-Nb) |
| Example 9(d) | H-13-(Ni—15Cr—4.8Mo—0.85Ti—6Al—(Nb + Ta)—Zr—B) |
| Example 9(e) | H-13-Ni base 16Cr—8.5Co—3.5Al—3.5Ti—2.6W—1.8Mo—0.9Nb |
| Example 9(f) | H-13-(Ni—20Cr)25$Cr_3C_2$. |

This particular structure presents a compositionally graded layer which varies in composition transversally, that is from the first contact with the H-13 steel substrate to the surface in contact with the molten copper (see FIG. 5). It should be clear that other materials from the various tables shown above can be used in a similar fashion achieving sets of multiple combinational gradients.

Example 10

In this particular example, the composition of a $Y_2O_3.ZrO_2$ mixture is varied by the following formula;

$$nY_2O_3(1-n)ZrO_2$$

Where n≦20% mol and n varies from 0≦20% along the distance away from the H-13 steel substrate and into the surface in contact with molten copper.

Example 11

In this particular example, the composition of a $Y_2O_3.ZrO_2$ mixture is varied by the following formula;

$$nY_2O_3(1-n)ZrO2$$

Where n≦20% mol and n varies from 20%≧0 along the distance away from the H-13 steel substrate and into the surface in contact with molten copper.

Example 12

In this example three layers are combined starting with NiCr—$CR_3C_2$ as the transitional layer adjacent to the H-13 steel substrate, this is followed by a layer of molybdenum silicide in combination with aluminum oxide ($MoSi_2$+$Al_2O_3$), to this second layer is added a third layer of aluminum oxide $Al_2O_3$, resulting in the following multilayer structure:

TABLE VII

| Tested Alloy Layers Bonded to H-13 Steel | |
|---|---|
| Example 12 | H-13-(NiCr—$Cr_3C_2$)—($MoSi_2$ + $Al_2O_3$)—$Al_2O_3$ |

While several structures have been described in detail, it will be apparent to those skilled in the art that the disclosed structures may be modified. Therefore, the foregoing description should be considered exemplary rather than limiting and therefore within the scope of the invention as defined in the claims which follow.

What is claimed:

1. A method for protecting the surface of a die useful for casting of copper articles, comprising providing a steel die and applying a protective coating to a surface of the die which coating is to be in contact with molten copper, wherein the protective coating comprises a transitional layer comprising $Al_2O_3$ in contact with the steel die; a second layer comprising $MoSi_2$+$Al_2O_3$ in contact with the transitional layer; and a third layer comprising NiCr—$Cr_3C_2$ in contact with the second layer.

2. The method of claim 1, wherein the steel is H-13 steel.

3. The method of claim 1, wherein the protective coating has a thickness in the range of from about 100 microns to about 400 microns.

4. A die for casting copper articles, comprising a die substrate comprised of a steel surface; and a protective coating comprising a transitional layer comprising $Al_2O_3$ in contact with the steel surface; a second layer comprising $MoSi_2$+$Al_2O_3$ in contact with the transitional layer; and a third layer comprising NiCr—$Cr_3C_2$ in contact with the second layer;

wherein the coating is adapted to contact molten copper when casting a copper article in the die.

5. The die of claim 4, wherein the steel surface is H-13 steel.

6. The die of claim 4, wherein the protective coating has a thickness in the range of from about 100 microns to about 400 microns.

* * * * *